United States Patent [19]

Chuzawa

[11] 4,427,959

[45] Jan. 24, 1984

[54] CIRCUIT PROTECTING SENSOR

[75] Inventor: Takaaki Chuzawa, Osaka, Japan

[73] Assignee: Matsushita Electric Works, Ltd., Osaka, Japan

[21] Appl. No.: 366,099

[22] Filed: Apr. 6, 1982

[51] Int. Cl.[3] ..... H01F 7/18; H01H 43/02

[52] U.S. Cl. ..... 335/239; 335/62

[58] Field of Search ..... 335/62, 61, 59, 239, 335/241, 29, 240

[56] References Cited

U.S. PATENT DOCUMENTS

| | | | |
|---|---|---|---|
| 2,462,753 | 2/1949 | Kyle, Jr. et al. . | |
| 2,519,291 | 8/1950 | Sandin et al. . | |
| 2,690,528 | 9/1954 | Wilckens | 335/239 |
| 2,698,404 | 12/1954 | Edwards | 335/240 |
| 3,226,605 | 12/1965 | Wright et al. | 335/240 |
| 3,943,476 | 3/1976 | Iyeta | 335/239 |

*Primary Examiner*—Harold Broome

*Attorney, Agent, or Firm*—Burns, Doane, Swecker & Mathis

[57] ABSTRACT

A circuit protecting sensor comprises a cylinder divided into two cylinder members with a common magnetic head interposed between them, one of which members contains a viscous fluid sealed therein and an oil plunger and the other member contains an operating plunger projecting partly out of the cylinder, and the respective plungers are biased by a spring normally away from the magnetic head. When a short-circuit current is detected by a coil wound on the cylinder, the operating plunger is immediately attracted by the magnetic head independently of the oil plunger prior to its attraction to the magnetic head.

9 Claims, 14 Drawing Figures

CIRCUIT PROTECTING SENSOR

This invention relates to a circuit protecting sensor which operates in response to a detection of short-circuit current or overcurrent higher than a rated current and, more particularly, to an abnormal current sensor which operates to protect associated circuit immediately when a short-circuit current is detected but with a time delaying action when an overcurrent slightly higher than the rated current is detected.

The circuit protecting sensor of the kind referred to can be incorporated in, for example, a circuit breaker that breaks a circuit to which the breaker is applied when an electric current over a rated current by a predetermined value flows in the circuit. As has been disclosed in, for example, U.S. Pat. No. 3,329,913 and Japanese Patent Publication No. 18258/1966, such circuit breaker generally comprises a fixed contactor having a fixed contact, a movable contactor carrying a movable contact contactable with the fixed contact, a manual contact opening and closing mechanism including a trip means which responds to any abnormal current for forcibly separating the movable contactor from the fixed contactor, and an arc suppressing means arranged adjacent the fixed and movable contacts, and the circuit protecting sensor is provided in the breaker in the form of an electromagnetic device operating in response to a short-circuit current or overcurrent to electromagnetically attract an associated armature linked to the trip means of the contact opening and closing mechanism.

When the short-circuit or overcurrent continues to flow through a detecting coil of the protecting sensor, the armature is attracted to the magnetic pole of the sensor, the movable contactor is caused to be separated from the fixed contactor to open the contacts, and the circuit is broken with respect to an input current source, while an arc produced when the contacts are rapidly opened is driven toward the arc suppressing means to be thereby divided minutely, cooled and suppressed.

It has been expected that, when applied to such circuit breaker or the like, the sensor will operate with a time delaying action when such current slightly higher than the rated current as, for example, a current more than 115% of the rated current is detected but, on the other hand, will operate immediately without the time delaying action when a short-circuit current is detected. However, in such circuit protecting sensors as the well known electromagnetic devices, the one of so-called oil dash-pot type having a time delaying action has been defective in that the operating time upon detection of the short-circuit current is relatively long and, in the case where such circuit element low in the withstand current as a semiconductor element is included in the circuit of the circuit breaker to which the sensor is applied, the element is caused to be damaged during the delayed operation. In order to solve such problems, there has been suggested a protecting sensor which operates only when a short-circuit current is detected without any time delay, but this has been still defective in that the sensor responds also to, for example, rush current and lacks in the universal usage.

A primary object of the present invention is, therefore, to provide a circuit protecting sensor which involves a sufficient time delaying action to operate gradually when an electric current slightly larger than a rated current is detected but, on the other hand, immediately operates within a very short time when a short-circuit current is detected.

Another object of the present invention is to provide a circuit protecting sensor showing an operating time reduced to a large extent so that, when applied to a circuit breaker, the time required for opening the contacts can be shortened and thereby the current limiting effect can be remarkably improved.

Still another object of the present invention is to provide a circuit protecting sensor which elevates the current limiting effect as applied to the curcuit breaker, so that any application of the short-circuit current to the circuit in which the circuit breaking is to be achieved can be minimized and any element low in the withstand current even if such element is included in the circuit.

Other objects and advantages of the present invention will become apparent from the following description of the invention detailed with reference to preferred embodiments shown in accompanying drawings, in which.

Figure 12:
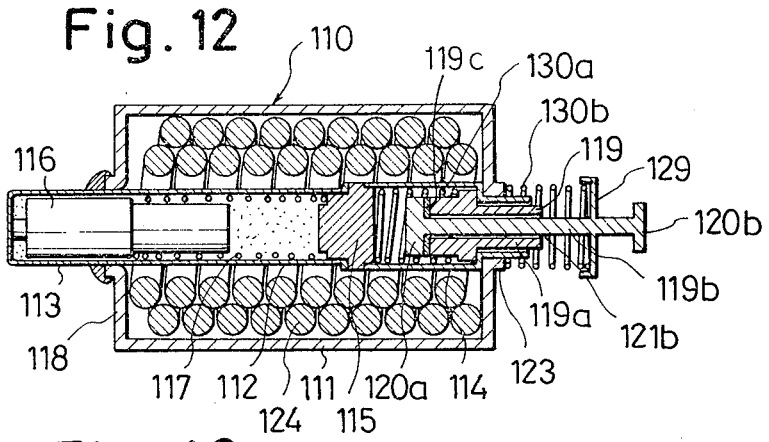
FIG. 12 is an axially sectioned view showing substantially in the similar manner to FIG. 2 another embodiment of the sensor according to the present invention in the state of non-operation.
Figure 13:
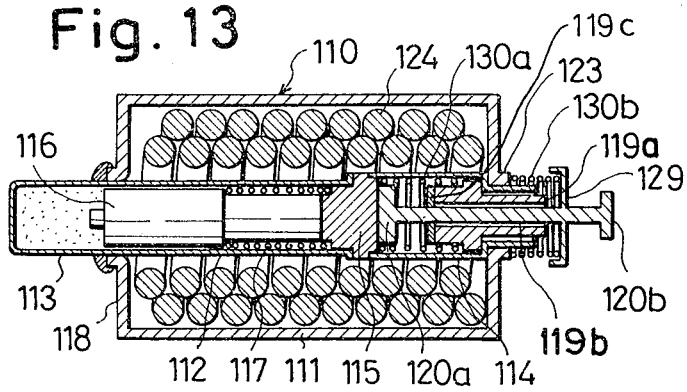
Figure 14:
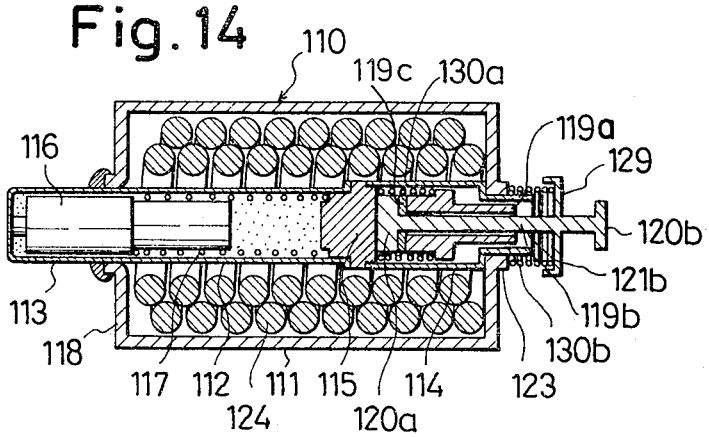

FIG. 13 is a sectioned view similar to FIG. 12 of the sensor shown therein but in the state when an overcurrent flows through a detecting coil of the sensor; and FIG. 14 is a sectioned view similar to FIG. 12 of the sensor shown therein but in the state when a short-circuit current flows through the detecting coil of the sensor, While the present invention shall now be explained in the followings with reference to the embodiments and examples of application shown in the drawings, it will be understood that the present invention is not to be limited only to them but is to include all modifications, alterations and equivalent arrangements possible within the scope of appended claims.

Figure 1:
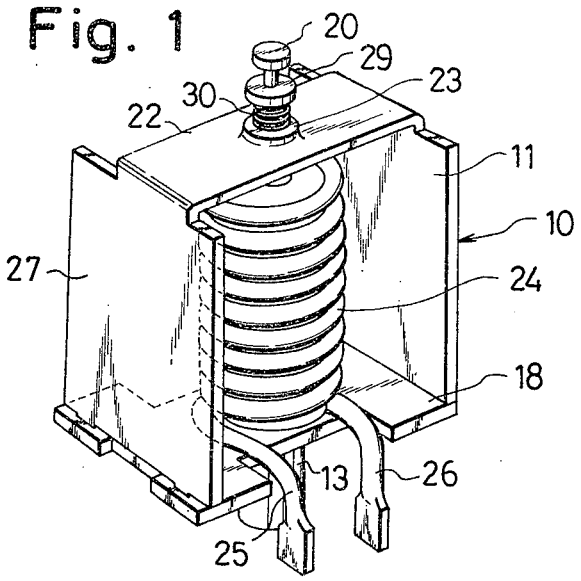
FIG. 1 is a perspective view of an embodiment of the circuit protecting sensor according to the present invention in non-operating state.
Figure 2:
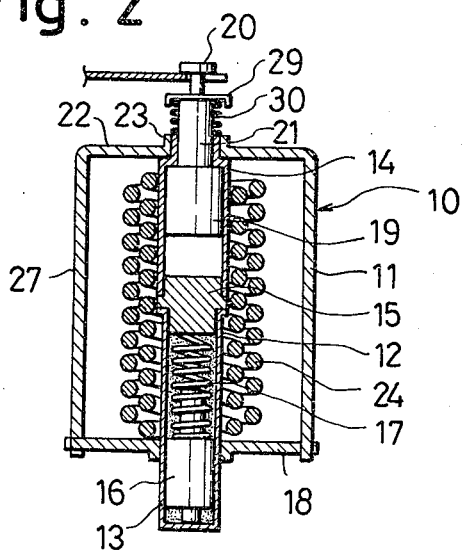
FIG. 2 is a vertically sectioned view of the sensor of FIG. 1.
Figure 3:
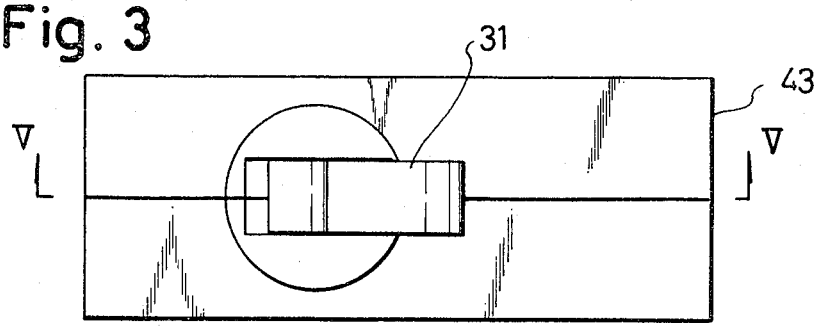
FIG. 3 is a top plan view of a circuit breaker shown as an example of application of the protecting sensor of the present invention with its movable and fixed contacts opened.

Referring to FIGS. 1 and 2, in an aspect of the present invention, a circuit protecting sensor 10 is provided with both functions of operating highly immediately when a short-circuit current is detected and of operating in response, with a time delaying action, to a detection of an overcurrent larger by a predetermined value than a rated current, by disposing two plungers in a common cylinder having a magnetic head 15 in the middle so as to have the magnetic head 15 held between them.

More specifically, the circuit protecting sensor 10 of the present invention comprises a yoke 11 of a magnetic member substantially rectangular in section and a cylinder 12 extending between the upper and lower side portions of the yoke 11 as fixed thereto. The cylinder 12 comprises a lower cylinder body 13 opened at the upper end and made of such non-magnetic material as preferably brass, and an upper cylinder body 14 opened at both ends and made of such non-magnetic material as preferably a plastic to have a diameter slightly larger than the lower cylinder body 13. A magnetic head 15 is fitted to the respective openings of the lower and upper cylinder bodies 13 and 14 so as to couple them with each other. Within the lower cylinder body 13, such viscous fluid as preferably a silicone oil is enclosed as sealed, and an oil plunger 16 made of a magnetic material and a coil spring 17 normally resiliently biasing the oil plunger 16 toward the inner surface of the bottom of the lower cylinder 13 are contained. Further, the lower cylinder body 13 is fixed to a lower side portion 18 of the yoke 11 as projected downward at the bottom end through the center of the lower side portion 18 so as to dispose the upper end of the oil plunger 16 substantially at the level of the lower side portion 18 of the yoke as being biased downward by the spring 17.

Further, within the upper cylinder body 14, an operating plunger 19 of a magnetic material is contained. A rod part 21 with which a head part 20 is integrally formed at the head end is fixed to the upper end of the plunger 19. The head part 20 is always projected outward and the rod part 21 is so provided as to also partly extend out of a constricted upper end part of the upper cylinder body 14 which is fitted at the upper end fixedly in a circular hole having a flange part 23 of the upper side portion 22 of the yoke 11.

Figure 4:
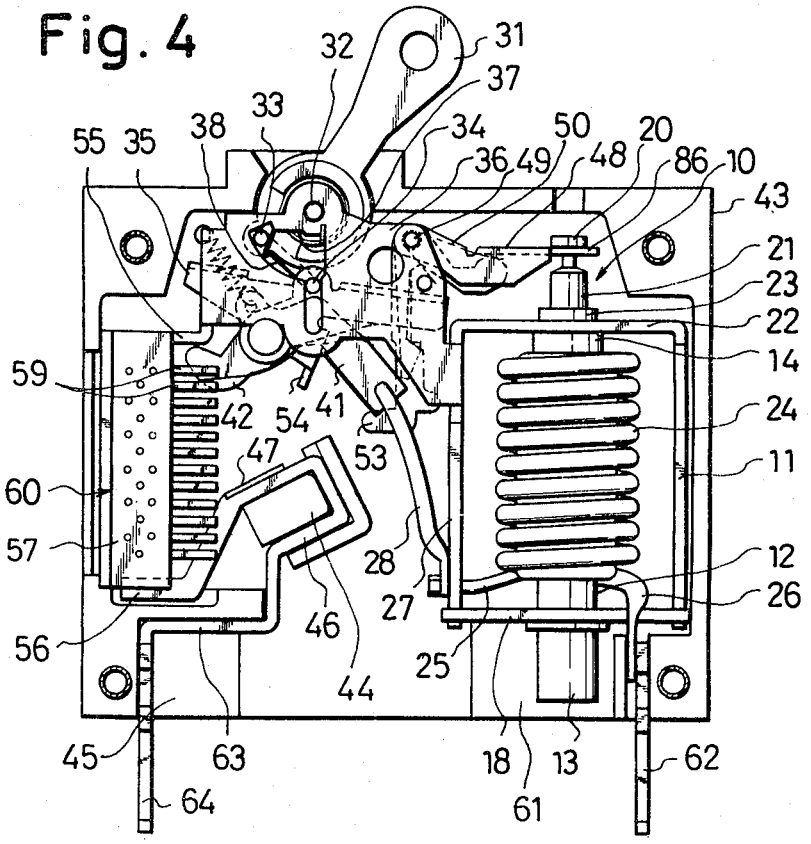
FIG. 4 is a side elevation of the circuit breaker of FIG. 3 with one of two-halve casings removed for showing its interior.
Figure 5:
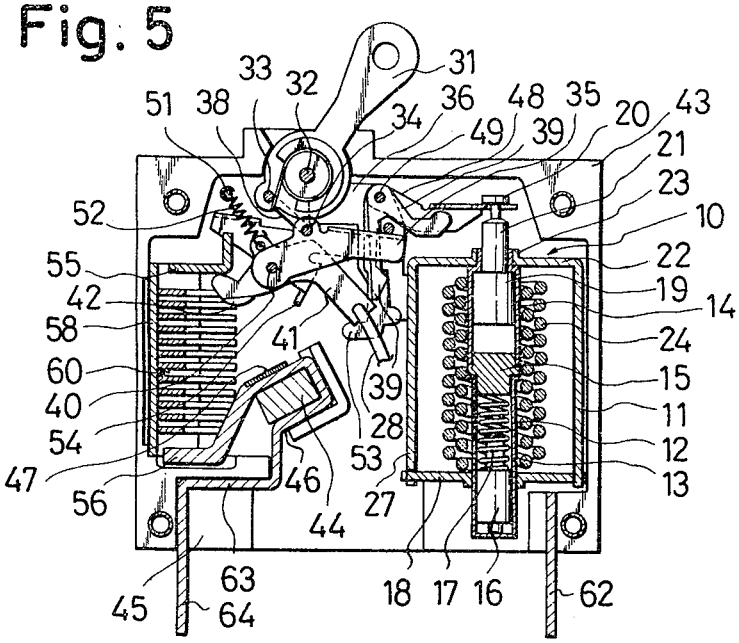
FIG. 5 is an elevation similar to FIG. 4 but with a reduced scale and with certain parts sectioned along line V—V in FIG 3.
Figure 6:
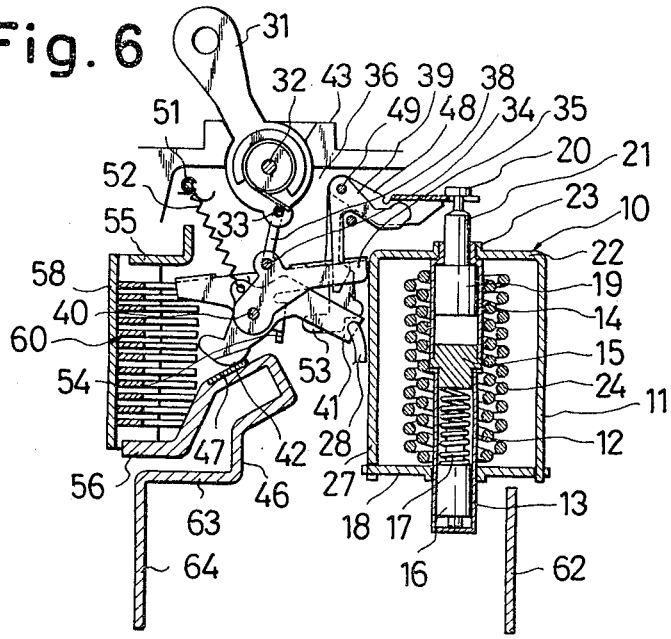
FIG. 6 is an elevation similar to FIG. 5 but with the movable and fixed contacts closed and with the most of the casing omitted.
Figure 7:
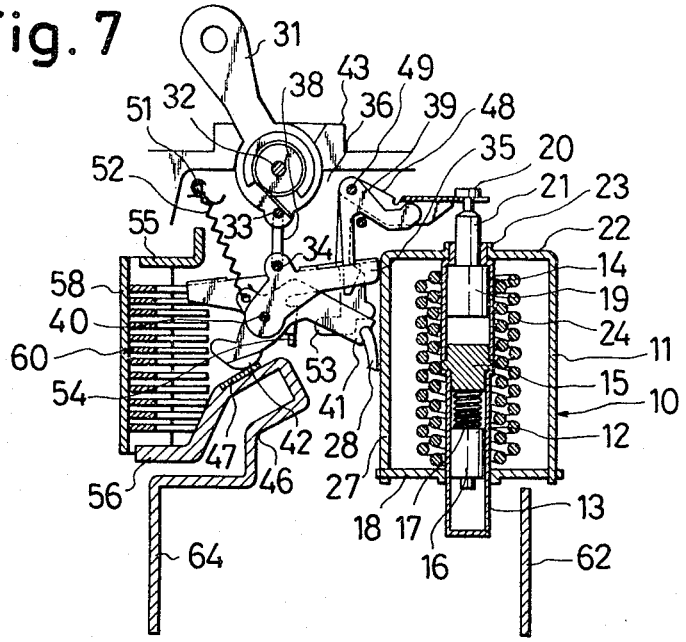
FIG. 7 is an elevation similar to FIG. 6 but showing a state at which an overcurrent begins to flow through a detecting coil of the sensor.

A detecting coil 24 is wound on the cylinder 12 substantially over the entire length in the axial direction of the cylinder and is led out of the yoke at both ends 25 and 26 to be connectable to the circuit in which an overcurrent and short-circuit current are to be detected so that, when the sensor is applied, for example, to a later described circuit breaker, one end 25 may be led out through one side portion 27 of the yoke 11 and connected to a lead wire 28 as seen in FIG. 4. In addition, a flange part 29 is formed on the rod part 21 of the plunger 19, and a coil spring 30 is arranged compressively between the flange part 29 and the upper end part of the upper cylinder body 14 to normally hold the operating plunger 19 in its uppermost or maximum extruded position.

Further, the operation of the circuit protecting sensor 10 of the present invention shall be explained in conjunction with the operation of the circuit breaker to which the inventive sensor is applied. Referring to FIGS. 3 to 9, the head part 20 of the operating plunger 19 of the sensor 10 is operatively connected with the trip means of the circuit breaker. An end 25 of the detecting coil 24 is connected with a movable contactor through the lead wire 28 and the other coil end 26 is connected with a terminal member of the circuit breaker. A handle 31 of a manual contact opening and closing mechanism of the circuit breaker is rotatable about a supporting shaft 32 as the center. A U-shaped link 38 is engaged at one leg part 33 to the handle 31 and at the other leg part 34 to a link arm 35 and loosely fitted in a sliding window 37 of a bearing frame 36. The latter is formed integrally with the yoke 11 and pivotably supports the link arm 35. If the handle 31 is rotated counterclockwise from the FIG. 4 or 5 positions to that of FIG. 6, the link 38 becomes positioned substantially vertical. At this time, the base end part of the link arm 35 comes into an engagement with a latch piece 39, and the link arm 35 is inclined downward at the other tip end part, whereby a movable contact 42 of a movable contactor 41, connected through a supporting shaft 40 to the link arm 35, is brought into contact with a fixed contact 47 of a fixed contactor 46 fixed in a casing 43 as held by holding bases 44 and 45 of the casing 43.

The latch piece 39 is so provided as to be simultaneously rotatable (about a supporting shaft 49 as the center) with an operatively connecting arm 48 of the trip means which is engaged directly with the head part 20 of the sensor 10. The latch piece 39 and arm 48 are rotatable in a clockwise direction in the drawings to be disengaged from the link arm 35 when the operating plunger 19 moves downward as described later. A coil spring 50 as shown by dotted lines in FIG. 4 is fitted around the supporting shaft 49 to normally rotate the connecting arm 48 counterclockwise in the drawings, whereby the coil spring 30 shown in FIGS. 1 and 2 as fitted around the rod part 21 of the operating plunger 19 in the sensor 10 can be omitted.

Figure 8:
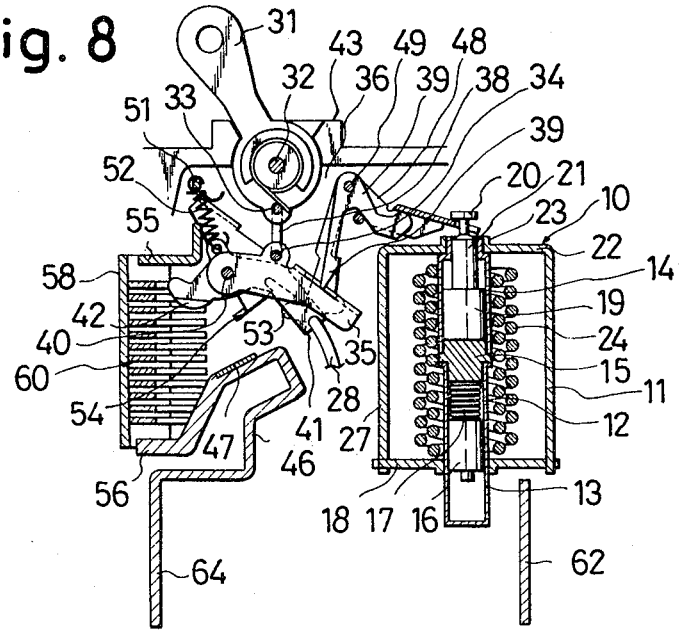
FIG. 8 is an elevation similar to FIG. 6 but showing the state at which the sensor is perfectly operated by the overcurrent to open the contacts.

When, in the state where the fixed contact 47 and movable contact 42 are thus closed, such overcurrent as, for example, of more than 115% of a rated current flows through the detecting coil 24 of the sensor 10, the magnetic head 15 is excited through the detecting coil 24. The oil plunger 16 is attracted by the excited magnetic head 15 relatively gradually against the coil spring 17 and the viscosity of the oil sealed in the lower cylinder body 13 and thereby a time delaying action is achieved so that, even if such overcurrent flowing for a relatively short time as a starting current is detected, the oil plunger 16 will not be caused to be attracted to the magnetic head. Further, when the oil plunger 16 is attracted to the magnetic head 15, the permeance of the magnetic circuit through the yoke 11 will increase and the operating plunger 19 normally biased into the uppermost position through the connecting arm 48 by the coil spring 50 will be relatively quickly attracted to the magnetic head 15 as shown in FIG. 8.

With the downward movement of this operating plunger 19, the connecting arm 48 and latch piece 39 operating integrally with the arm will rotate about the supporting shaft 49 as the center. The latch piece 39 separates from the link arm 35 and the movable contactor 41 is quickly separated from the fixed contactor 46 by the tension of a return spring 52 hung between the movable contactor 41 connected to the link arm 35 and a tip end 51 of the frame 36. If an arrangement is made so that a downward projection 54 of the link arm 35 will be kicked by a foot part 53 of the operatively connecting arm 48 with the rotation of the arm at this time, the response to the detecting operation of the sensor 10 can be optimumly increased.

Figure 9:
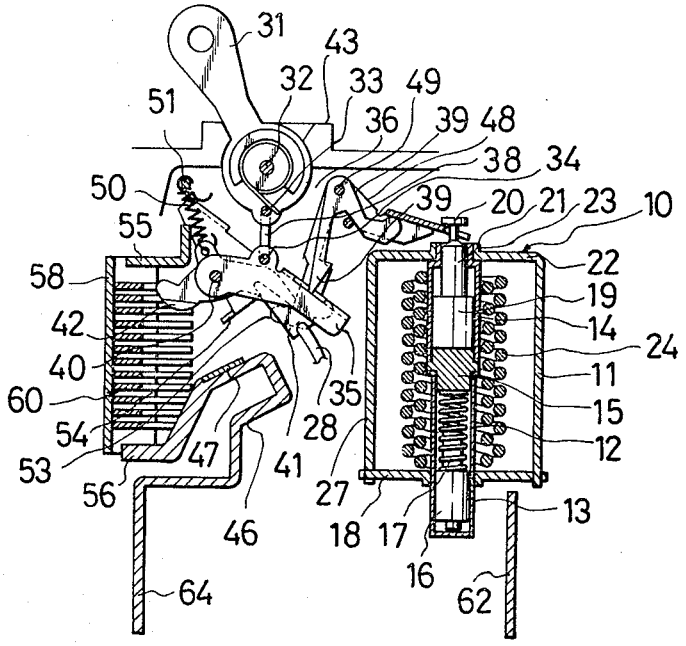
FIG. 9 is an elevation similar to FIG. 6 but showing the state where a short-circuit current flows through the sensor applied to the same and the contacts are thereby opened.

When a short-circuit current of, for example, more than 200 to 300% of the rated current flows through the detecting coil 24, on the other hand, in the foregoing state of the contacts closed, a strong magnetic field is generated in the detecting coil 24 and the operating plunger 19 within the upper cylinder 14 is immediately quickly attracted to the magnetic head 15 as shown in FIG. 9 without waiting for the oil plunger 16 of the lower cylinder 13 to be attracted to the magnetic head 15.

With the downward movement of this operating plunger 19, the connecting arm 48 and latch piece 39 operating integrally with the arm are caused to rotate about the supporting shaft 49 as the center and, the same as described above, the movable contactor 41 is quickly separated from the fixed contactor 46. The arc produced when the contacts are quickly opened will be divided, cooled and suppressed in an arc suppressing means 60 arranged between upper and lower arc running plates 55 and 56 and comprising deion grids 59 respectively fixed at regular intervals to a side plate 57 and back plate 58. Further, it will be easily understood by those skilled in the art that, in the above described circuit breaker, the circuit protecting sensor is positioned by means of a base part 61 made within the casing 43. The detecting coil 24 is connected at one end to a terminal member 62, and the fixed contactor 46 is connected to another terminal member 64 through a connecting part 63 so that a detected current can be passed therethrough.

Figure 10:
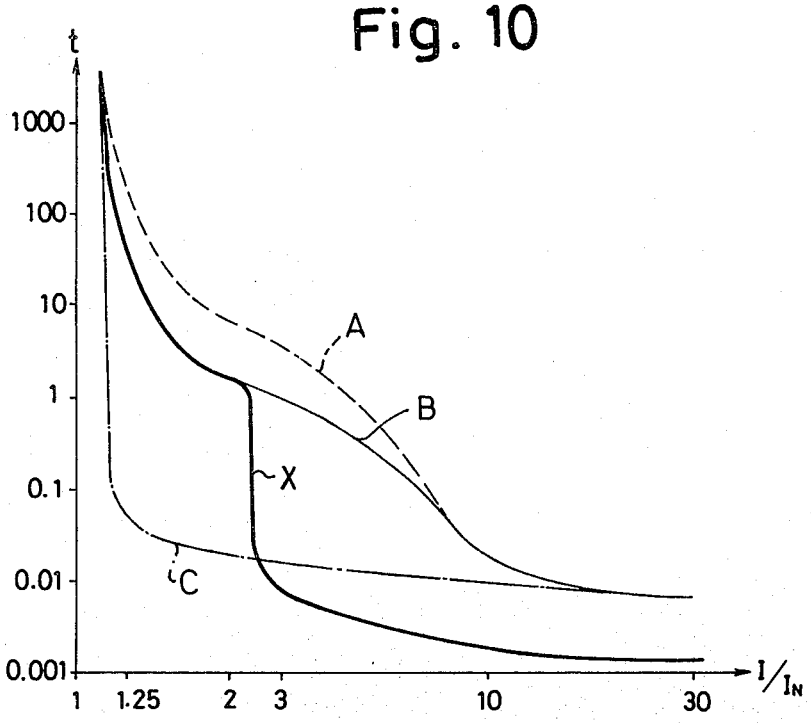
FIG. 10 is a diagram showing relations of the time of passing a current through the sensor shown in FIGS. 1 and 2 to the operating time as compared with those of conventional products.

The operation characteristics of the above described circuit protecting sensor according to the present invention shall be explained in the followings with reference to FIG. 10. It is found that, in the case of the sensor 10 of the present invention, as shown by the curve X, the sensor operates comparatively slowly with an overcurrent up to about twice as large as the rated current but, on the other hand, with such current as greatly exceeding twice as large as the rated current, it can be operated with an operating time less than 0.01 second and further, with a large current exceeding 10 times as large as the rated current, the operating time will greatly less than 0.01 second so as to be close to 0.01 second. On the other hand, in the case of a conventional circuit protecting sensor having a time delaying action, normally as shown by the characteristic curve A, the operating time will require more than 1 second even when a short-circuit current about three times as large as the rated current flows. Further, even in a conventional protecting sensor having a time delaying action made high in the speed by improving, for example, the magnetic characteristics, as shown by the curve B, an improvement can be seen up to a current about twice as large as the rated current but, with a short-circuit current exceeding three times as large as the rated current, the operating time has required almost one second. Therefore, it has not been able to apply the sensor to such case that an element low in the withstand current such as a semiconductor element is included in the circuit to be protected by means of the circuit breaker. On the other hand, in a conventional protecting sensor intended to be used mostly for instantaneous response, no time delaying action is provided and the operating time can be made short as shown by the curve C but, even if a current less than about 1.25 times as large as the rated current flows for about 0.1 second, the sensor operates so that it will be likely to operate even in response, for example, to the starting electric power of the circuit associated with the sensor and only a poor universality can be obtained for the usage, and even with a current exceeding 10 times as large as the rated current an operating time of about 0.01 second is required, resulting in that the instantaneous response has been still poor.

Figure 11:
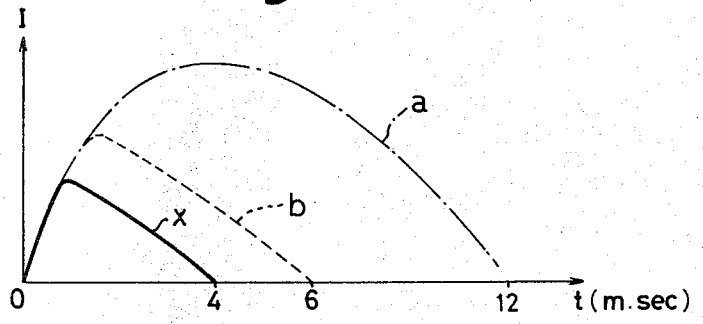
FIG. 11 is a diagram showing arc suppressing characteristics of the same sensor as in FIG. 10 as applied to a circuit breaker.

In addition, the operation characteristics of the circuit breaker provided with the protecting sensor according to the present invention can be improved to a large extent so that the peak value of the arc voltage can be reached within a very short time, whereby the current limiting effect is remarkably improved. Therefore, it is found that, when the protecting sensor according to the present invention is set in an ordinary conventional circuit breaker which requires an arc suppressing time of substantially 12 m.sec. without any arc suppressing means as shown by the curve "a" of a chain line in FIG. 11 and substantially about 6 m.sec. with an arc suppressing means as shown in the curve "b" of a dotted line in the drawing, the suppressing time can be improved to be substantially remarkably less than 5 m.sec. as shown by the curve "x" of a solid line.

According to another aspect of the present invention, there is suggested another embodiment wherein the operating plunger comprises a first plunger operating responsive to the overcurrent and a second plunger responsive to the short-circuit current. Referring to FIG. 12, the members respectively corresponding to those used in the embodiment of FIGS. 1 and 2 are denoted by adding 100 to their respective reference numerals. In an operating plunger 119 of a protecting sensor 110 of this embodiment, a second plunger **119*b* is inserted coaxially through a first plunger 119*a* which operates responsive to the short-circuit current and movably in the axial direction of the first plunger 119*a*. Further, an attracting head part 120*a* positioned within a cylinder 112 is fixed to one end of the second plunger 119*b* and an operating head part 120*b* positioned outside the cylinder 112 is fixed to the other end and a non-magnetic spacer 119*c* is arranged between opposing end faces of the first and second plungers 119*a* and 119*b*. Further, a coil spring 130*b* arranged between a flange part 129 provided on a rod part 121*b* of the second plunger 119*b* and an end of the cylinder 112 or a yoke 111 acts to resiliently bias the second plunger 119*b* and first plunger 119*a* axially outward with respect to the cylinder 112. A second coil spring 130*a* partly surrounding the both plungers 119*a* and 119*b* and arranged between an intermediate magnetic head 115 and the first plunger 119*a* is arranged within a cylinder body 114 housing therein the first and second plungers 119*a* and 119*b***.

When the overcurrent flows in this embodiment through a detecting coil 124 around the cylinder 112, as shown in FIG. 13, an oil plunger 116 opposing the operating plunger 119 is attracted to the intermediate head 115 and, thereafter, only the second plunger **119*b* is attracted to the head 115. On the other hand, when the short-circuit current flows, as shown in FIG. 14, the first and second plungers 119*a* and 119*b* are both attracted immediately to the head 115 against the coil spring 130*b* and independent of the attracted movement of the oil plunger 116**. Therefore, the provision of the second plunger operating independently responsive to the overcurrent in the operating plunger enables it possible to control an interrupting pickup current and to adapt the sensor sufficiently to any overflowing current in the case of candescent lamps and any motor starting current.

In this embodiment of FIGS. 12 to 14, other arrangements and operations than those referred to in the foregoings are substantially the same as in the embodiment of FIGS. 1 and 2 and detailed references thereto are omitted here.

In the circuit protecting sensor of the present invention formed as described above, there can be realized such effects that a sufficient time delaying effect can be achieved, a remarkably instantaneous response can be well attained so that, as applied, for example, to the circuit breaker, the current limiting action can be greatly improved, it can be adopted without any obstruction in a circuit including an element low in the withstand current, thus sufficiently universal usages can be well attained, the mass of the plunger responsive specifically to the short-circuit current can be reduced when a single operating plunger is employed so as to improve the instantaneous response.

What is claimed as my invention is:

1. A circuit protecting sensor for protecting an associated circuit from an overcurrent or short-circuit current, comprising a cylinder divided into first and second cylinder bodies coupled axially endwise with a magnetic head interposed between them and fixed thereto, a yoke in which said cylinder is fixed, with said first cylinder body projected partly out of said yoke, a detecting coil wound around the cylinder, a fluid plunger contained together with a viscous fluid in said first cylinder body to a spring-load acting in the direction separating the body to be axially movable toward and away from said magnetic head, a first spring means provided for normally biasing said fluid plunger in a direction away from the magnetic head, an operating plunger contained in said second cylinder body to be axially movable toward and away from the magnetic head in opposing relationship to movements of the fluid plunger, one end of said operating plunger being projected out of the cylinder to be engageable with an actuating part of an external device, and a second spring means provided for normally biasing said operating plunger in a direction away from the magnetic head.

2. A sensor according to claim 1, wherein said magnetic head is fitted to respective opposing end openings of said first and second cylinder bodies.

3. A sensor according to claim 1, wherein said first spring means comprises a coil spring contained in said first cylinder body between said fluid plunger and said magnetic head, and said second spring means comprises a coil spring arranged between a flange provided to said projected end of said operating plunger and an end of said second cylinder body.

4. A sensor according to claim 1, wherein said projected end of said operating plunger is provided with a head part fixed to the projected end, said head part being connectible to an actuating part of the external device.

5. A sensor according to claim 1, wherein said operating plunger comprises a first plunger part operating in response to an overcurrent and a second plunger part axially extending through said first plunger part and operating in response to a short-circuit current, said second plunger part having said projected end, and said second spring means acts on said first and second plunger parts.

6. A sensor according to claim 5, wherein said second spring means comprises an outer coil spring disposed between a flange made adjacent said projected end of said second plunger part and an end of said second cylinder body, and an inner coil spring arranged between said magnetic head and said first plunger part within the second cylinder body.

7. A sensor according to claim 5, wherein said second plunger part of said operating plunger is provided at an end with a head part positioned within said second cylinder body and attractable to said magnetic head, and at the other end forming said projected end with an operating head part positioned outside the second cylinder body.

8. A sensor according to claim 5, wherein said magnetic head is fitted to respective opposing end openings of said first and second cylinder bodies.

9. A sensor according to claim 5, wherein said first spring means is a coil spring contained within said first cylinder body between said fluid plunger part and said magnetic head.

* * * * *